United States Patent [19]

Horikawa et al.

[11] 4,411,365

[45] Oct. 25, 1983

[54] MOISTURE PROOF CONTAINER WITH AN OUTER BOX AND AN INNER BAG OPENED SIMULTANEOUSLY

[75] Inventors: Hisao Horikawa, Funabashi; Mitsuru Kano, Tokyo, both of Japan

[73] Assignee: Toppan Printing Co., Ltd., Japan

[21] Appl. No.: 340,457

[22] Filed: Jan. 18, 1982

Related U.S. Application Data

[63] Continuation of Ser. No. 65,178, Aug. 9, 1979, abandoned.

[30] Foreign Application Priority Data

Aug. 17, 1978 [JP] Japan ..... 53-112800
Oct. 11, 1978 [JP] Japan ..... 53-139485

[51] Int. Cl.[3] ..... B65D 5/54; B65D 5/56

[52] U.S. Cl. ..... 206/607; 206/611; 206/613; 206/633; 220/462; 229/DIG. 5

[58] Field of Search ..... 220/462, 463, 416, 418; 206/622, 625, 605, 607, 611, 613, 633, 631, 612; 229/17 R, DIG. 5

[56] References Cited

U.S. PATENT DOCUMENTS

| | | | |
|---|---|---|---|
| 2,200,818 | 5/1940 | Bergstein | 220/463 |
| 2,856,114 | 10/1958 | Guyer | 220/418 |
| 3,113,712 | 12/1963 | Kindseth . | |
| 3,339,820 | 9/1967 | Krzyzanowski | 220/462 |
| 3,357,631 | 12/1967 | Aid et al. | 206/625 X |
| 3,389,852 | 6/1968 | Egli . | |
| 3,392,901 | 7/1968 | Krzyzanowski | 220/462 |
| 3,580,466 | 5/1971 | Thelen | 229/17 R X |
| 3,580,483 | 5/1971 | Young | 220/418 X |
| 3,741,463 | 6/1973 | Young et al. | 229/17 R |
| 3,768,719 | 10/1973 | Johnson | 220/462 |

FOREIGN PATENT DOCUMENTS

| | | |
|---|---|---|
| 43-22980 | 3/1973 | Japan . |
| 52-01334 | 2/1977 | Japan . |

*Primary Examiner*—Allan N. Shoap
*Attorney, Agent, or Firm*—Lerner, David, Littenberg, Krumholz & Mentlik

[57] ABSTRACT

The present invention relates to a paper box formed from blanks of cardboard having an inner bag, and more particularly to a moisture proof container which performs a function of simultaneously opening an outer box and an inner bag, in which the outer box and the inner bag may be opened simultaneously without deforming the outer box by opening an opening place formed by tear-away lines bored from a top panel to a front panel of the outer box. The invention provides a moisture proof container with an outer box and an inner bag which may be opened simultaneously, comprising an outer box formed from blanks of cardboard or the like and an inner bag formed from blanks of moisture proof sheet material, characterized in that opening tear-away lines are bored from a top panel to a front panel of the outer box, the inner bag has its opposed ends of the moisture proof material overlapped and adhered together to form a cylindrical body, and one end of the material is struck on the surface within the outer box so that the end is positioned in the opening place of the outer box.

8 Claims, 9 Drawing Figures

MOISTURE PROOF CONTAINER WITH AN OUTER BOX AND AN INNER BAG OPENED SIMULTANEOUSLY

This is a continuation of application Ser. No. 065,178, filed Aug. 9, 1979, now abandoned.

BACKGROUND OF THE INVENTION

1. Field of the Invention

The present invention relates to a moisture proof container which performs a function of simultaneously opening an outer box and an inner bag, in which the outer box and the inner bag may be opened simultaneously without deforming the outer box by opening place formed in the outer box.

2. Description of the Prior Art (1) Japanese Utility Model Application No. 13334/77 (Utility Model Laid-open No. 108529/78)

This reference discloses a paper box in which an inner bag is housed in an outer box having a zipper laterally disposed at the upper part of the body. This provides an arrangement wherein the outer box is opened by the zipper to expose the opening portion of the inner bag, but does not disclose an idea in which the opening portion of the outer box and the inner bag are bonded so as to open the outer box and inner bag simulaneously.

(2) Japanese Utility Model Application No. 22980/68 (Utility Model Publication No. 9389/73)

In this reference, the lid in a trapezoid taking-out portion of a packing outer box and the moisture proof wrapping paper are fixed together and the lid of the outer box may be pulled to thereby cut off the wrapping paper. No elaboration is made however, regarding the moisture proof wrapping paper. Also, the paper is merely fixed to the lid of the outer box; thus the paper may not be torn away in a given direction.

(3) Japanese Utility Model Application No. 54815/70 (Utility Model Publication No. 15836/71)

In this reference, the outer package is partially provided with a tear-up portion, to which a portion of the inner package directly thereunder is pasted so that the inner package may be ripped open together with the outer package. No elaboration is made to the inner package. It appears that the inner package is merely stuck on the tear-up portion. Thus, tearing-away in a given direction is not possible.

SUMMARY OF THE INVENTION

The present invention provides a paper box formed of cardboard having an inner bag, and more particularly, a moisture proof container having a simultaneous opening function in which when the fixed portion of an outer box is opened, the inner bag may also be opened simultaneously therewith without deforming the outer box. Also, the present invention provides a box which has a good opening property, produces no deformation when opened and has a high strength. The box is characterized in that a thermal adhesive is coated on a back seal portion of the inner bag for example in an undulated or saw-tooth shape, and preferably is provided with a notch in the adhered portion of the inner bag in order to increase a ripping property of the inner bag at the time of opening, whereby when the opening place of the outer box is raised, the inner bag may be easily opened simultaneously from the back seal portion without deforming the outer box.

BRIEF DESCRIPTION OF THE DRAWINGS

The drawings show one embodiment of the present invention in which.

DESCRIPTION OF THE PREFERRED EMBODIMENTS

Figure 1:
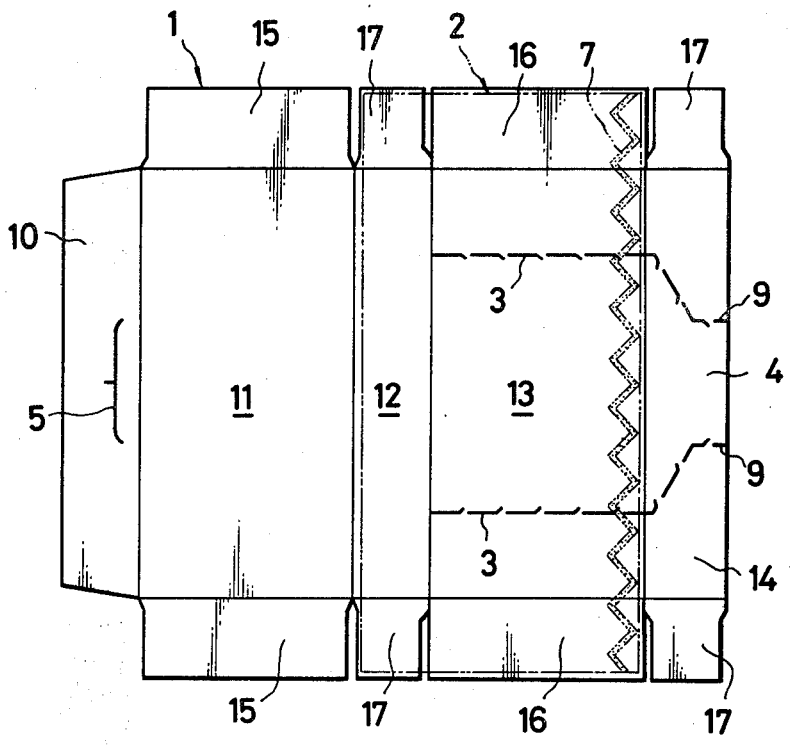
FIG. 1 is a developed plan view of an outer box in accordance with the present invention.

The present invention will now be described in detail in connection with embodiments shown in the drawings.

Figure 2:
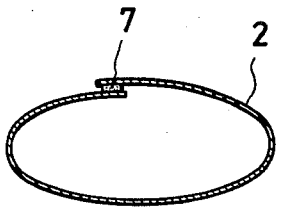
FIG. 2 is a sectional view of an inner bag in accordance with the present invention.
Figure 3:
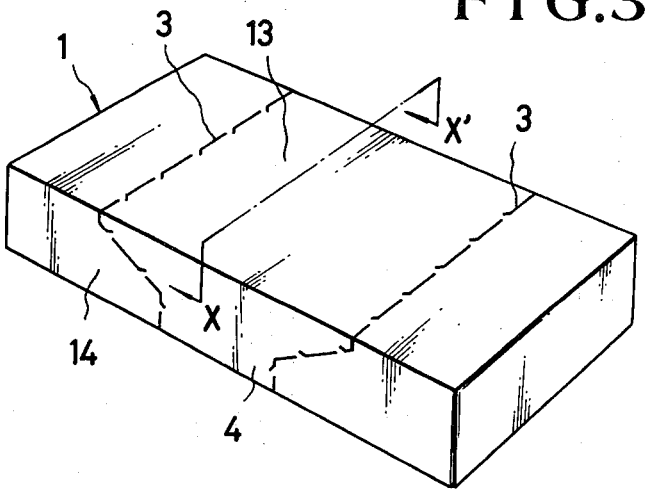
FIG. 3 is a perspective view of a container in accordance with the present invention.

Referring first to FIG. 1, which is a developed plan view, the outer box 1 of the present invention comprises an inner front panel 10, a bottom panel 11, a rear panel 12, a top panel 13, and a front panel 14 disposed successively along longitudinal creases as shown, and further comprises inner panels 15, 15 and outer panels 16, 16 disposed on the upper and lower ends of the bottom panel 11 and top panel 13, respectively, through lateral creases, and flaps 17, 17, 17, 17 disposed on the upper and lower ends of the front panel 14 and rear panel 12, respectively. The top panel 13 has a tear-away line 3 bored therein which extends generally in a direction parallel to the lateral crease, the tear-away line 3 starting from the longitudinal crease, which forms a boundary line with the rear panel 12, and terminating at the front panel 14, thus forming a projection or a tab 4. The container is composed of the outer box 1 provided with a cut 5 in a portion corresponding to the inner front panel 10 so as to receive the tab 4, and an inner bag 2 having a width substantially equal to the sum of widths of the top panel 13 and rear panel 12 of the outer box 1 and having a height substantially equal to the sum of heights of the top panel 13 and outer panels 16, 16. The inner bag 2 is formed from a sheet material having a moisture proof property and a property tearable in a given direction. As shown in section in FIG. 2, for example, the sheet material forming the inner bag 2 may comprise a plastic film such as polyethylene having a uniaxially oriented directivity which is laminated for example on an aluminum foil. The outer surface of the opposed end of said sheet is coated with resin, hot melt lacquer, heat seal lacquer, etc., which has good adhesiveness and peeling off properties, in an undulated or saw-tooth fashion, the end being adhered at 7 to form a cylindrical body. According to the characteristic feature of the present invention, as shown in FIG. 1, FIG.

Figure 4:
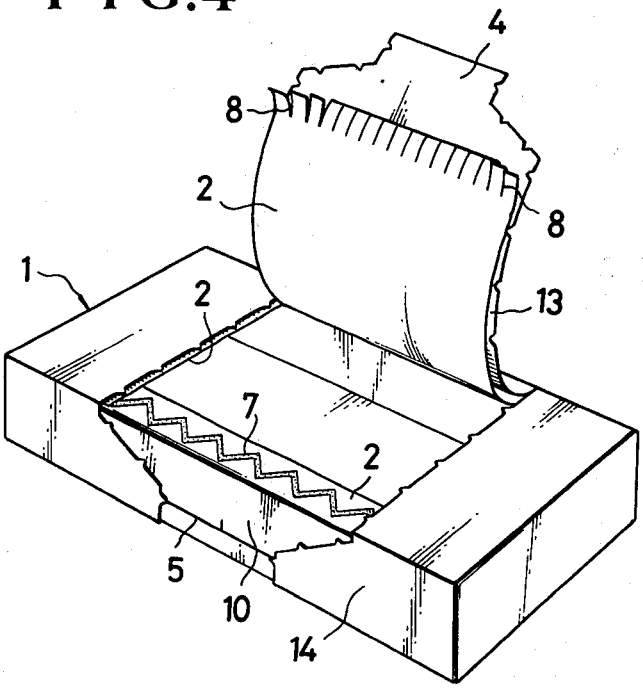
FIG. 4 is a perspective view with the container of the invention in an opened state.
Figure 5:
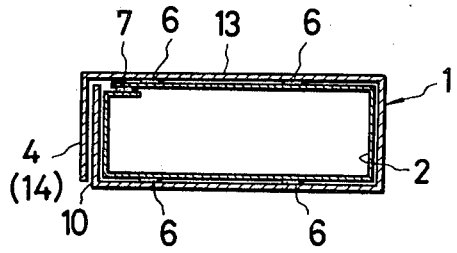
FIG. 5 is a sectional view taken on line X—X' of FIG. 3.
Figure 7:
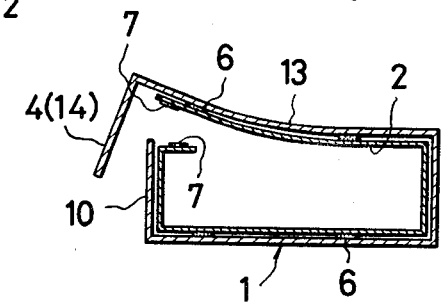
FIG. 7 is a sectional view, similar to that shown in FIG. 5 showing the opened state of a box in accordance with the embodiment of FIGS. 4 and 5.

3 (which is a perspective view of the container in accordance with the present invention), and FIG. 4 (which is a perspective view with the container opened), when the inner bag 2 is stuck or adhesively secured to the outer box 1 at the desired sticking portion 6 thereof (see FIG. 5), the undulated or saw-tooth shaped adhered portion 7 of the inner bag 2 is positioned adjacent the inner surface of the top panel 13 and the inner front panel 10 of the outer box 1 at a substantially right angle to the elongated direction of the film and the opening tear-away line 3 of the outer box 1. It is important that as seen in the sectional view of FIGS. 5–9, the overlapping direction of the adhered portion of the inner bag 2 coincides with the overlapping direction of cardboard of the outer box 1 and that the adhesion to the top panel 13 of the outer box 1 is achieved in the vicinity of the sheet material on the upper side of the adhered portion 7 of the inner bag 2.

In use of the container in accordance with the present invention, when the tab 4 of the outer box 1 is held by fingers and pulled, the portion encircled by the tear-away line 3 of the top panel 13 as well as the front panel 14 are ripped along the tear-away line 3. Since the outer box 1 and the inner bag 2 are stuck or adhered (as at 6) together as previously described and also as the oriented direction of the film and the opening tear-away line 3 of the outer box 1 are at a right angle to the adhered portion 7 of the undulated or saw-tooth shape, the inner bag 2 is, at the portion of the inner bag 2 substantially encircled by the tear-away line 3 of the outer box 1, peeled off from the adhered portion 7 and then ripped along the orientated direction to form an opening as shown in FIG. 4. In this case, it is a prerequisite that in forming the inner bag 2, the inner surface and outer surface of the opposed ends of the sheet material are overlapped for thermal adhesion. In addition, the sheet of the undulated or saw-tooth adhered portion 7 may be formed with a notch or series of notches 8 as shown in FIG. 4 to facilitate the ripping.

Figure 6:
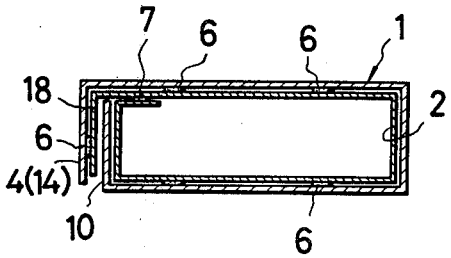
FIG. 6 is a sectional view, similar to that shown in FIG. 5, showing another embodiment in accordance with the present invention.
Figure 8:
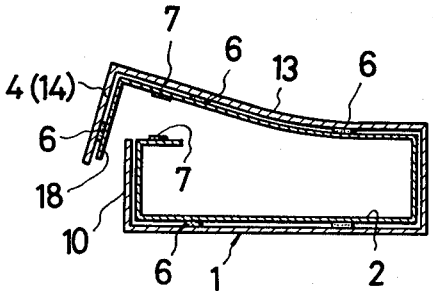
FIG. 8 is a sectional view, similar to that shown in FIG. 6 showing the opened state of the embodiment of the box shown in FIG. 6.

Further, if an extended end 18 extending towards the outside of the adhered portion 7 of the inner bag 2 is stuck or adhesively secured (as at 6) to the inner side of the tab 4 both, the inner bag 2 and the tab 4 of the outer box 1 may be gripped when opened, whereby opening can be done easily as shown in the sectional views of FIGS. 6 and 8, thus providing positive opening.

With the arrangement as described above, in the present invention, when the outer box 1 is ripped along the tear-away line 3, the inner bag 2 may also be ripped simultaneously in the oriented direction. Also, when an uniaxially oriented plastic film laminated on aluminum is used to form the inner bag 2, the bag 2 offers a moisture proof effect. In addition, in the thermally adhered portion 7 of the inner bag at which the inner and outer surfaces of plastic film sheet are adhered together, if adhesion is achieved by a thermal adhesive having a good peeling off property which is coated in an undulated or saw-tooth shaped fashion (so-called envelope sticking), the tension applied to the outer box 1 when opened is dispersed at the undulated or saw-tooth shaped places so that for example, there occurs no deformation at places such as the inner surface panel thereby, resulting in a good ripping property to facilitate opening, which is a great advantage.

Figure 9:
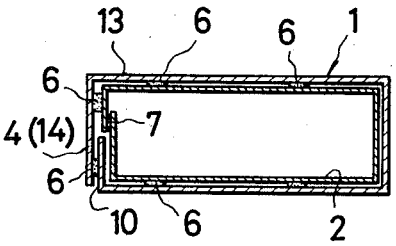
FIG. 9 is a sectional view, similar to that shown in FIG. 5, showing a still further embodiment in accordance with the present invention.

In FIG. 9, there is shown a further embodiment in accordance with the present invention in which the inner bag 2 is adhesively secured (as at 6) within the outer box 1 so that the adhered portion 7 of the inner bag 2 is arranged adjacent to the front panel 14 of the outer box 1. In this embodiment, a portion of the inner bag immediately adjacent the adhered portion 7 is secured to the front panel 14, as at 6, and further, a portion of the front panel 14 is adhesively secured to the inner front panel 10, as at 6.

What is claimed is:

1. A moisture proof container comprising:

an outer closed box formed from a blank of box material, said outer box having a wall section comprised of first and second overlapping panel sections of said blank of box material, said first panel section overlapping said second panel section on the outside of said second panel section, said outer box having a pair of spaced tear away lines through a portion thereof which includes said first panel section to define an openable panel portion;

a substantially closed inner bag within said outer box, said inner bag formed from a blank of moisture proof uniaxially oriented sheet material having a uniaxial orientation extending in a first direction, said sheet material having a first portion and a second portion, said first portion of said sheet material prior to formation of said inner bag being spaced along said sheet material in said first direction from said second portion of said sheet material, and said sheet material being arranged to form said inner bag in a manner such that said first portion overlaps and is releasably adhered by releasable adhesive means to said second portion to define an adhered section of said inner bag, said adhered section extending in a second direction which is at right angles to said first direction of said sheet material, said substantially closed inner bag being adhesively secured within said outer box with at least a part of said sheet material adjacent to said first portion adhesively secured to said openable panel portion of said outer box, said substantially closed inner bag being secured within said outer box in a manner (i) such that the orientation of the direction of overlap of said first portion with respect to said second portion of said sheet material forming said inner bag coincides with the direction of overlap of said first panel section with respect to said second panel section of said outer box, (ii) such that said adhered section of said inner bag crosses at right angles to said spaced tear away lines of said outer box, and (iii) such that said adhesively secured part of said sheet material adjacent to said first portion is non-releasable from said openable panel portion relative to said releasably adhered first and second portions of said sheet material, and said first portion being releasably adhered to said second portion and said inner bag being adhesively secured within said outer box such that when said openable panel portion is opened by tearing along said tear away lines, said first portion between said tear away lines is released and separates from said second portion of said sheet material to thereby move with said openable panel portion with said second portion remaining in position in said outer box, whereby said inner bag is opened simultaneously with said openable panel portion.

2. The moisture proof container of claim 1 wherein said outer box includes a front panel having said first panel section therein and a top panel joined to said front panel and extending transversely thereof, said tear away lines extending through said front panel and said top panel so that said openable panel portion is defined in said front panel and said top panel of said outer box.

3. The moisture proof container of claim 2 wherein said inner bag is adhesively secured within said outer box so that said adhered section is positioned adjacent the inner surface of said front panel of said outer box.

4. The moisture proof container of claim 2 wherein said inner bag is adhesively secured within said outer box so that said adhered section is positioned adjacent the inner surface of said top panel of said outer box.

5. The moisture proof container of claim 4 wherein said blank of sheet material from which said inner bag is formed includes an extended end which is displaced from said first portion of said sheet material so that said first portion along said sheet material is intermediate said extended end and said second portion prior to formation of said inner bag, wherein said inner bag is formed from said sheet material so that said extended end is separate from said adhered section of said inner bag, and wherein said inner bag is adhesively secured within said outer box so that said extended end is positioned and adhered adjacent the inner surface of said front panel of said outer box.

6. The moisture proof container of claim 1 wherein said first portion of said sheet material is releasably adhered to said second portion of said sheet material to form said inner bag with a thermal adhesive which is interposed between said first and second portions.

7. The moisture proof container of claim 6 wherein said thermal adhesive is applied between said first portion and second second portion of said inner bag in an undulating configuration.

8. The moisture proof container of claim 7 further including a notch adjacent said first portion of said inner bag for facilitating ripping of said inner bag thereat.

* * * * *